US005410853A

United States Patent [19]

Hartleif

[11] Patent Number: 5,410,853

[45] Date of Patent: May 2, 1995

[54] CEILING LINING

[75] Inventor: Karl-Heinz Hartleif, Reilingen, Germany

[73] Assignee: Hartleif Metalldecken GmbH, Hockenheim, Germany

[21] Appl. No.: 348,491

[22] PCT Filed: Aug. 17, 1988

[86] PCT No.: PCT/EP88/00736

§ 371 Date: May 23, 1989

§ 102(e) Date: May 23, 1989

[87] PCT Pub. No.: WO89/01552

PCT Pub. Date: Feb. 23, 1989

[30] Foreign Application Priority Data

Aug. 18, 1987 [DE] Germany ..... 8711244 U

[51] Int. Cl.[6] ..... E06B 3/54

[52] U.S. Cl. ..... 52/773; 52/506.07

[58] Field of Search ..... 52/488, 764, 766, 769, 52/770, 773, 774, 484, 463, 464, 471, 235; 49/498.1

[56] References Cited

U.S. PATENT DOCUMENTS

| | | | |
|---|---|---|---|
| 2,882,561 | 4/1959 | Schrode | 52/773 |
| 3,367,077 | 2/1968 | Johnston | 52/464 |
| 4,744,188 | 5/1988 | Ahren | 52/488 X |
| 5,117,587 | 6/1992 | Doan | 49/498.1 X |

FOREIGN PATENT DOCUMENTS

| | | | |
|---|---|---|---|
| 295593 | 1/1954 | Switzerland | 52/463 |

*Primary Examiner*—Carl D. Friedman
*Assistant Examiner*—Creighton Smith
*Attorney, Agent, or Firm*—Young, MacFarlane & Wood

[57] ABSTRACT

A metallic ceiling facing comprises a supporting grid and cassettes. The supporting grid has longitudinal struts and transverse struts provided with projections upon which the cassettes lie in a sealing manner. In order to obtain a cassette arrangement that satisfies aesthetic requirements and ensures the tightness required, the projections have vertically projecting webs upon which the cassettes rest. Seals are mounted on the projections and bear against the cassettes in the mounted position. A secure, consistent mechanical arrangement of the cassettes in the supporting grid is thus ensured, as well as a sufficiently tight sealing fit.

19 Claims, 9 Drawing Sheets

CEILING LINING

The present invention relates to a ceiling lining of metal, consisting of a supporting grid and of cassettes arranged in the grid compartments of the supporting grid which is composed of longitudinal struts and of transverse struts connected to said longitudinal struts, each longitudinal strut and each transverse strut having substantially horizontal projections which are arranged on either side at the lower ends of said struts, extend in the longitudinal directions thereof, and are provided on their top sides with seals, upon which sealingly lie the cassettes.

In gas-tight ceiling linings such as are used above all in the clinical field, in laboratories, or in manufacturing facilities which are super-purity rooms, it is required that the supporting grid is designed in such manner that the cassettes are not only in a completely tightly sealing contact with the supporting grid, but can also be readily mounted and dismounted. Further, such ceiling linings must meet high optical requirements, i.e. particularly in ceiling linings which have a very large surface an exact arrangement of the cassettes must be possible.

From West German Patent 26 24 956 there is known a suspended ceiling in which the seals are arranged at the projections of the struts in such manner that the cassettes come to lie immediately upon the seals. This, however, has the disadvantage that the seals are fully loaded by the weight of the cassettes and thus very strongly compressed. Therefore, due to the elasticity of the seals, the cassettes do not rest in the grid evenly enough that the ceiling facing would completely meet the high optical requirements. Further, due to the immediate surface contact, it cannot be guaranteed that the cassettes are everywhere tight and sealed off.

The present invention is based upon the problem to provide a ceiling lining of the above mentioned kind, which is of simple structure, stable, optically pleasant and gas-tight, with variable grid sizes, and in which the cassettes can be easily mounted and dismounted.

According to the present invention, this problem is solved in that on the top side of the projection there is arranged a web which extends upward and along said projection and upon which rests the cassette.

The ceiling lining according to the invention is characterized by a number of significant advantages. Thus, according to the invention it is possible to place the cassettes immediately upon the webs of the supporting grid, whereby on the one hand an even and safe support of the cassettes is ensured, and on the other hand an exact alignment between the cassettes and the supporting grid which also meets the optical requirements can be achieved. Another essential advantage of the present invention resides in that, contrary to the prior art, the weight of the cassettes does not rest immediately upon the seals but is carried by the webs, while the seals are only in contact with the respective surfaces of the cassettes in order to provide for a gas-tight sealing. Thus, damaging of the seals can be avoided. Further, since the cassettes always completely rest upon the respective webs, it is also ensured that the seals are in engagement along the entire circumference of the cassettes so that a gas-tight sealing is guaranteed.

In a preferred embodiment of the invention the seal is disposed between the web and the side wall of the longitudinal strut and of the transverse strut respectively. Thus, even when the cassette is dismounted, the seal is protected against damaging, and in particular the seal is not visible when the cassette is in the assembled condition, whereby the optical impression as a whole is not impaired.

In order to obtain a good and uniform sealing effect, it may prove advantageous to design the seal tube-like and to provide it with a height which, in the unloaded condition, is larger than the height of the web. Thus, the seal is deformed by the cassette to a predetermined extent, and due to the elasticity of the seal a contact with the surface of the cassette can be obtained to an extent which is sufficient to ensure the sealing effect.

According to the invention, the seal may also have a rectangular cross-section or a solid section ("full profile"), in which case it is then advantageous that the sealing material as a whole exhibits sufficient elasticity.

In order to join the seal in a safe manner to the projection, the seal has preferably a plane contact surface which, for example, may be glued onto the projection. Such a plane contact surface may be provided both in a tubular and in a rectangular seal.

In order to ensure a gas-tight sealing, the seal is preferably manufactured of an elastic material with a closed surface, such as for example a foam material with closed pores, or the like.

In a further development of the invention, an additional web may be arranged parallel to the web between the same and the wall of the longitudinal strut or of the transverse strut respectively. Such additional web serves to provide a U-shaped channel cross-section, in which the seal is placed.

Due to such design, it is excluded that the seal is damaged by spring members which are arranged on the longitudinal strut and on the transverse strut.

Further, it may prove to be of advantage that along its outer lower edge region the cassette has a circumferential step-like fold, whereby the cassette comes to lie with the horizontal surface of the step-like fold on the projections or on the webs. Due to the design of the step-like fold it is possible to arrange the lower surface of the cassette in such manner that it is flush with the lower surfaces of the longitudinal struts and the transverse struts.

In order to ensure a uniform contact of the cassettes and a uniform sealing effect, it may be provided that the lateral projections of the longitudinal struts and the lateral projections of the transverse struts have the same design.

In order to hold the cassettes in the position which they have in the assembled condition, it is favorable that spring members which secure the cassettes in their position are held on the longitudinal struts and/or on the transverse struts. In a preferred embodiment the springs are designed as leaf springs, the ends of which are supported in grooves which are arranged and opposing each other in the side walls of the longitudinal or transverse struts. Such a spring design provides for a particularly easy mounting and removing of the cassettes, and a clamping effect which prevents the cassette from being removed can be safely excluded.

Further, it may prove to be of advantage that the grooves are defined by the respective side wall and a parallel web extending downward from the upper end of the side wall on the one hand, and by a web which is arranged on the top side of the projection and extends upward parallel to the side wall on the other hand. Such a design ensures that the spring members are safely supported and fixed. Thus, due to the spring members the cassettes are firmly supported on the webs of the projections. Thereby the cassettes are not only supported accurately from the optical point of view, but in respect of the required sealing effect they are also pressed to get into close contact with the seals.

In order to further improve the support and the clamp-fit of the cassettes on the webs, it can be provided according to the invention that the springs have between their two ends an angular portion whose one leg extends in a substantially vertical direction, is resiliently supported against the lateral face of the cassette and extends approximately as far as the upper edge of the cassette, and whose other leg extends above the upper edge of the cassette and is angularly bent, sloping upward and inclined outward with respect to the side wall of the strut. Also, it may be favorable that one leg is followed by a leg extending preferably in a straight line to the lower groove, and that the other leg is followed by a leg extending preferably in a straight line to the upper groove. Further, the legs of the spring which extend to the grooves may be followed by spring end sections extending parallel to the side wall of the strut. In all these embodiments the contact pressure of the cassettes against the webs is improved, and a sufficient sealing is ensured. Since the sizes of the grid compartments, that is the dimensions of the supporting grid, often cannot be matched exactly with the size of the ceiling that is to be lined, it is provided according to the invention that the grid compartments are limited by a wall end strut in the region of transition to a wall. Due to such design, the ceiling lining may be sealingly joined even with irregular wall forms. Further, it may be favorable that the wall end strut has a horizontal projection, which extends in the longitudinal direction thereof and on whose upper side there is arranged a seal which may be brought into contact with the cassette. Such design provides for a gas-tight sealing also in the region of transition to a wall.

In a further embodiment of the wall end strut it can be provided that above the first projection there is arranged a parallel second projection, under which the horizontal portion of the cassette can be introduced. Thus, the cassette is supported and guided in a U-shaped groove, and displacement of the cassette or unintentional disengagement is excluded.

In order to obtain a safe sealing in the region of transition to a wall, it can be further provided that the seal has a U-shaped cross-section and that it is supported on the second projection and has at least one sealing lip pointing in the direction of the first projection. In the mounted condition, the sealing lip abuts the horizontal portion of the cassette and provides for a gas-tight sealing. As the sealing lip extends into the U-shaped area between the first and the second projection, a sufficient initial stressing force of the seal is ensured at the same time.

In a particularly advantageous embodiment of the invention the cassette is provided with sealingly mounted ancillary devices, such as for example a lamp, or air supply or air discharge installations. This is particularly advantageous because additional installations or ancillary devices cannot cause additional leakages (untightnesses).

Examples of embodiment of the present invention are described hereinafter more in detail, reference being had to the accompanying drawings in which FIG. 1 is a view from below of a portion of the supporting grid according to the invention;

Figure 3:
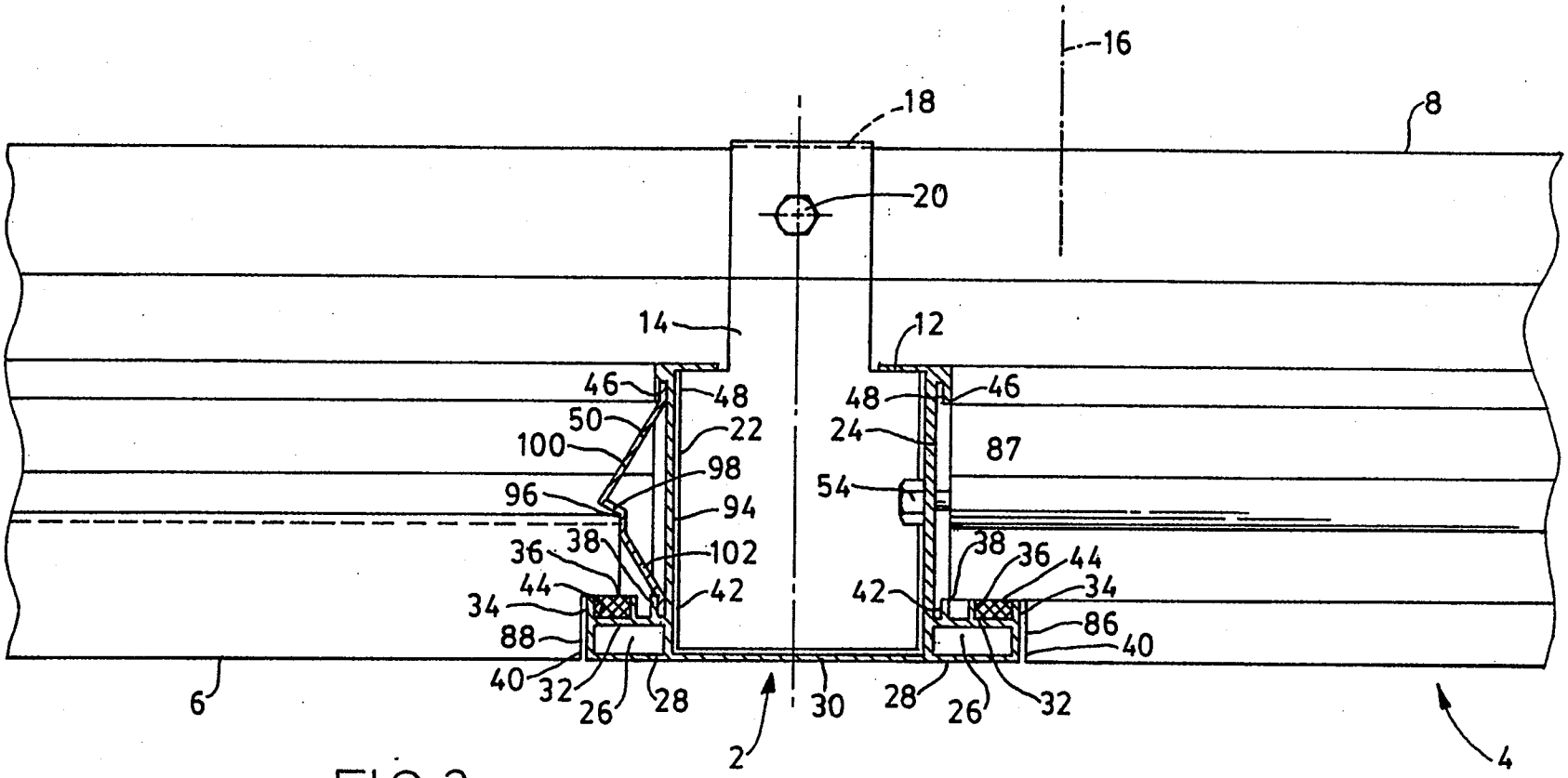
FIG. 3 is a sectional view along the line III/III according to FIG. 1 through a longitudinal strut of the supporting grid with a cassette in the assembled condition.
Figure 4:
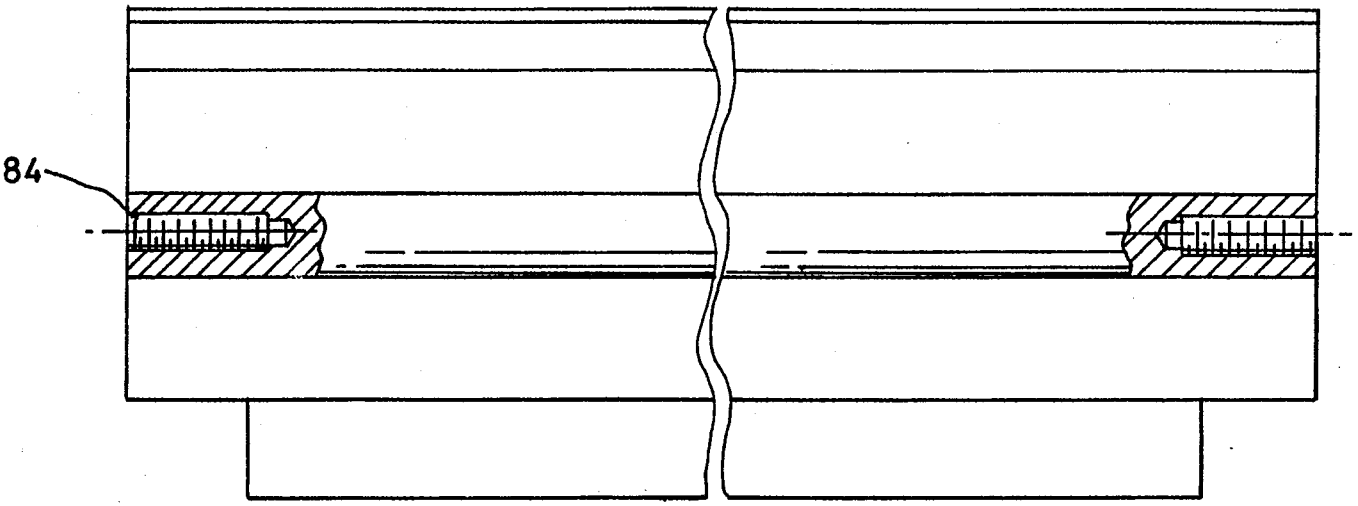
FIG. 4 is a side view of a transverse strut according to FIG. 1, partly sectioned.

The ceiling lining according to the present invention consists substantially of parallel longitudinal struts 2 which are horizontally arranged, of transverse struts 4 which are arranged between the longitudinal struts 2 and whose ends are fastened to the longitudinal struts, and of cassettes 6 which are carried by the longitudinal struts 2 and the transverse struts 4. As can be seen in FIG. 3, the longitudinal struts 2 are fastened to girders 8 via suspension tongues 14 extending upward from the top side 12 of the longitudinal struts 2, said girders 8 being adjustable in height, e.g. by means of thread rods 16, relative to the room ceiling (not shown). The suspension tongues 14 of the longitudinal struts 2 are angularly bent at their upper ends, whereby the longitudinal struts can be suspended on the girders 8 by means of the horizontal angle leg 18 of the suspension tongue 14. In addition, the suspension tongues 14 are secured to the girders 8 by means of screws 20.

The longitudinal struts 2 and the transverse struts 4 are made as aluminum profiles. The cassettes 6 carried by the longitudinal struts 2 and the transverse struts 4 are made of electrolytically zinc-coated sheet steel. The visible sides both of the cassettes 6 and of the longitudinal struts 2 as well as of the transverse struts 4 are coated with thermoset lacquer having e.g. the shade RAL 9010.

The form of the longitudinal struts 2 can be seen particularly in FIG. 3. The longitudinal struts 2 are designed as essentially rectangular box profiles, the top side 12 of the box profile being opened for the most part in order to make the interior thereof accessible. Along the two long sides 22, 24 of the box profile there are arranged laterally projecting continuous supports 26 extending in the longitudinal direction of the longitudinal struts. These supports 26 also have a box profile-like design, and their undersides 28 are in a plane with the underside 30 of the box profile-like longitudinal strut 2.

On the upward-facing top side 32 of each support 26 there are disposed three vertical webs 34, 36, 38 extending in the longitudinal direction of the longitudinal strut 2. The outer web 34 is an extension of the side wall 40 of the box profile-like support 26, the web 38 is arranged near the long side 22 of the longitudinal strut 2 and defines a groove 42 therewith, and the web 36 is arranged between the web 34 and the web 38.

Between the web 34 and the web 36 there is placed a sealing strip 44, which may consist for example of rubber, extends over the entire length of the longitudinal strut and in the non-compressed condition projects slightly beyond the upper edges of the webs 34, 36.

In each upper region of the two long sides 22, 24 there is arranged a downward pointing web 46 parallel to the long sides and extending over the entire length of the long sides, which webs 46 define a groove 48 between themselves and the adjacent side walls 22 and 24 respectively. The opposing grooves 42, 48 serve to receive springs 50 which are described below further in detail.

Figure 5:
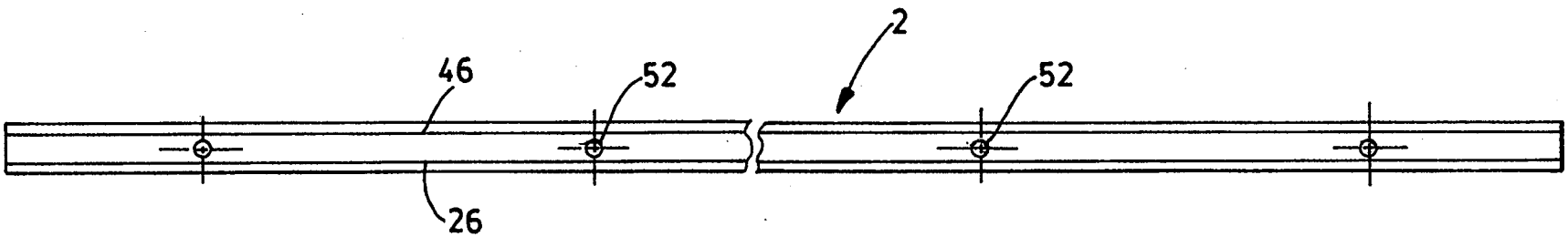
FIG. 5 is a side view of a longitudinal strut according to FIG. 1.

As can be seen in FIG. 5, in the long sides 22, 24 of the longitudinal struts 2, approximately halfway up, there are provided through bores 52 in a given grid distance of e.g. 60 cm for receiving screws 54 which serve to secure the transverse struts 4 to the longitudinal struts 2 in a force-locking manner. The entire width of the longitudinal struts 2 including their supports 26 can be about 10 cm, the height about 7.2 cm.

In order to obtain a transverse stiffening of the longitudinal struts, zinc-plated grate angles with additional diagonal struts as thrust traverses are provided at a distance of e.g. 100 cm.

Figure 1:
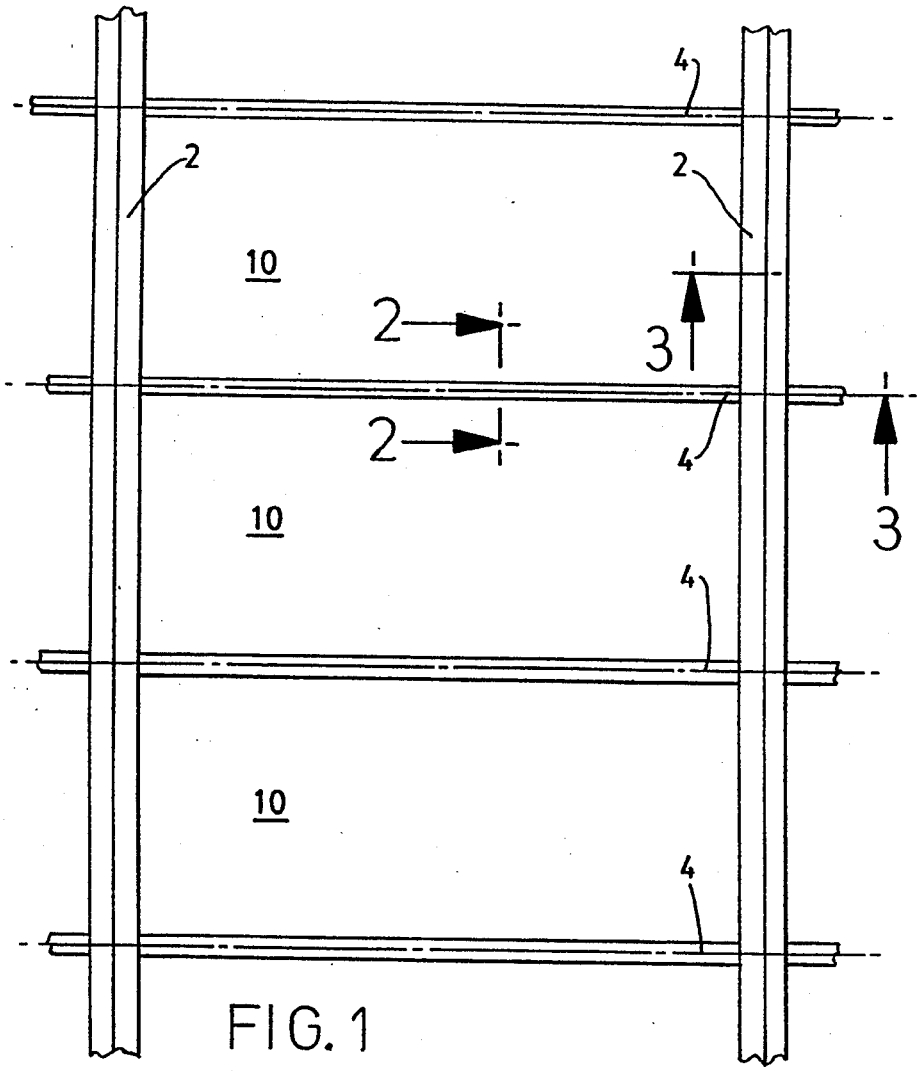
Figure 2:
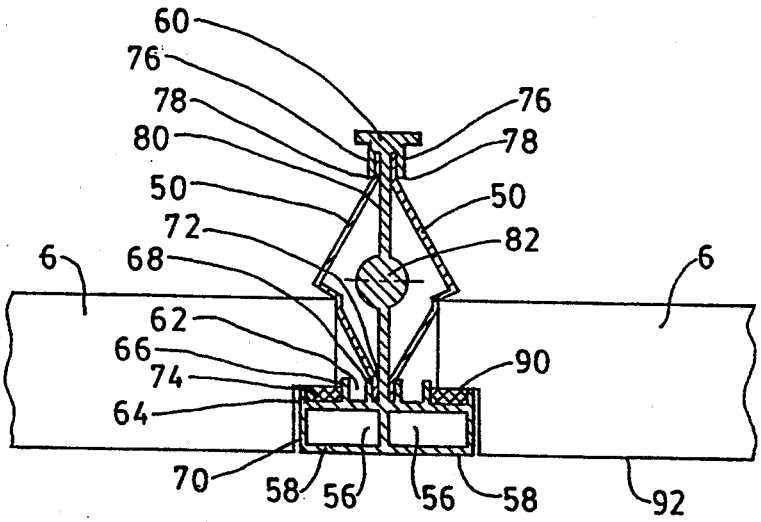
FIG. 2 is a partial sectional view through a transverse strut along the line II/II of FIG. 1, with cassettes in the assembled condition.

The structure of the transverse struts 4 can be seen particularly from FIG. 2. The transverse struts 4 are also designed as aluminium profiles and comprise an upright ridge 80, along the lower end of which there are arranged supports 56 extending in the longitudinal direction on both sides of the ridge 80. The undersides 58 of the supports 56 are at the same time the undersides of the transverse struts. The supports 56 have the same cross-section as the supports 26 of the longitudinal struts 2 and consequently have the form of a box profile with side walls 70 and top sides 62, from which longitudinal webs 64, 66, 68 extend upwards. Further, sealing strips 74 are arranged between the webs 64, 66, and grooves 72 are defined between the webs 68 and the adjacent side face of the ridge 80.

Along the upper end of the ridge 80, similar as in the case of the longitudinal struts 2, there are arranged downward pointing webs 76 extending in the longitudinal direction which define grooves 78 between themselves and the adjacent lateral faces of the ridge 80. As in the case of the longitudinal struts 2, the opposing grooves 72, 78 serve to receive the end portions of the springs 50. Along the upper edge of the transverse struts 4 there is arranged a stiffening rib 60 extending at right angles to the plane of the ridge 80.

The ridge 80 has a substantially centrally disposed thickening 82 extending in the longitudinal direction of the ridge 80. In the center of the thickening 82 there is disposed a taphole 84 extending in the longitudinal direction of the transverse strut 4. As can be seen in FIG. 3, the lower edges of the transverse struts 4 are provided with step-like rectangular recesses 86 which are dimensioned such that, when the transverse struts 4 are applied to the longitudinal struts 2, the upper horizontal surfaces of the recesses 86 of the transverse struts 4 rest on the supports 26 and simultaneously the front faces 87 of the transverse struts 4 lie against the outsides of the webs 46 of the longitudinal struts 2. In the case of the embodiment described herein, the width of the transverse struts 4 may be about 4 cm, and the height of the transverse struts 4 corresponds to the height of the longitudinal struts 2 and is thus 7.2 cm.

For fastening the transverse struts 4 to the longitudinal struts 2, the screws 54 are guided from the interior of the longitudinal struts 2 through the through-bores 52 of the long sides 22, 24 of the longitudinal struts 2 and tapped into the tapholes 84 of the transverse struts 4 which face the through-bores 52.

The dimensions of the cassettes 6 are somewhat smaller than the grid sizes defined by the long sides 22, 24 of the longitudinal struts and the outsides of the ridge 80 of the transverse struts, but larger than the grid sizes defined by the side walls 40, 70 of the supports 26, 56. Along their lower outer edge the cassettes 6 have a circumferential step-like fold 88. When the cassettes 6 are positioned in the grid compartments 10 defined by the longitudinal struts 2 and the transverse struts 4, the horizontal surfaces 90 of said step-like folds 88 rest in a tight manner on the sealing strips 44, 74 which are carried by the supports 26, 56. The height of the step-like folds 88 is such that the undersides 92 are flush with the undersides of the longitudinal struts 2 and of the transverse struts 4.

For fixing the position of the cassettes 6 there are provided the springs 50 which are secured to the longitudinal struts 2 and the transverse struts 4. At each of their two ends the springs 50 have a leg extending parallel to the long sides 22, 24 and to the ridge 80 respectively, the lower leg of the spring 50 being guided in the grooves 42 and 72 respectively, and the upper leg of the spring 50 being guided in the upper grooves 48 and 78 respectively. The central portion of the spring 50 comprises a vertical leg 94 which lies against the side wall of the cassette 6 in the region of the upper edge thereof, extends upward as far as the upper edge 96 of the cassette, and is tensioned against the cassette. The vertical leg of the spring 50 is followed by a short leg 98 sloping upward and inclined outward. From the outer end of said leg 98 a leg 100 extending in a straight line leads to the upper end section of the spring 50 which is guided in the grooves 48 and 78 respectively. From the lower end of the vertical leg 94 another leg 102 of the spring 50 extending in a straight line leads to the lower end section of the spring 50 which is guided in the grooves 42 and 72 respectively.

In the embodiment described herein, for each cassette 6 six springs 50 are distributed along the longitudinal struts 2 and the transverse struts 4. By compressing the legs 100, 102 the springs 50 can be inserted in a simple manner into the guide grooves at the respective desired positions. Also, if required, the springs 50 can be displaced inside the guide grooves. When the cassettes are being inserted into the grid compartments 10, the lower edges of the cassettes 6 impinge upon the legs 100 of the springs 50, pushing them laterally away. As soon as the cassettes have reached their desired position shown in the Figures, the legs 98, 100 of the springs 50 snap outward over the upper edge of the cassettes 6, and simultaneously the vertical legs 94 come to lie against the lateral faces of the cassettes 6. In this way, the cassettes 6 are safely supported in their final position.

Figure 6:
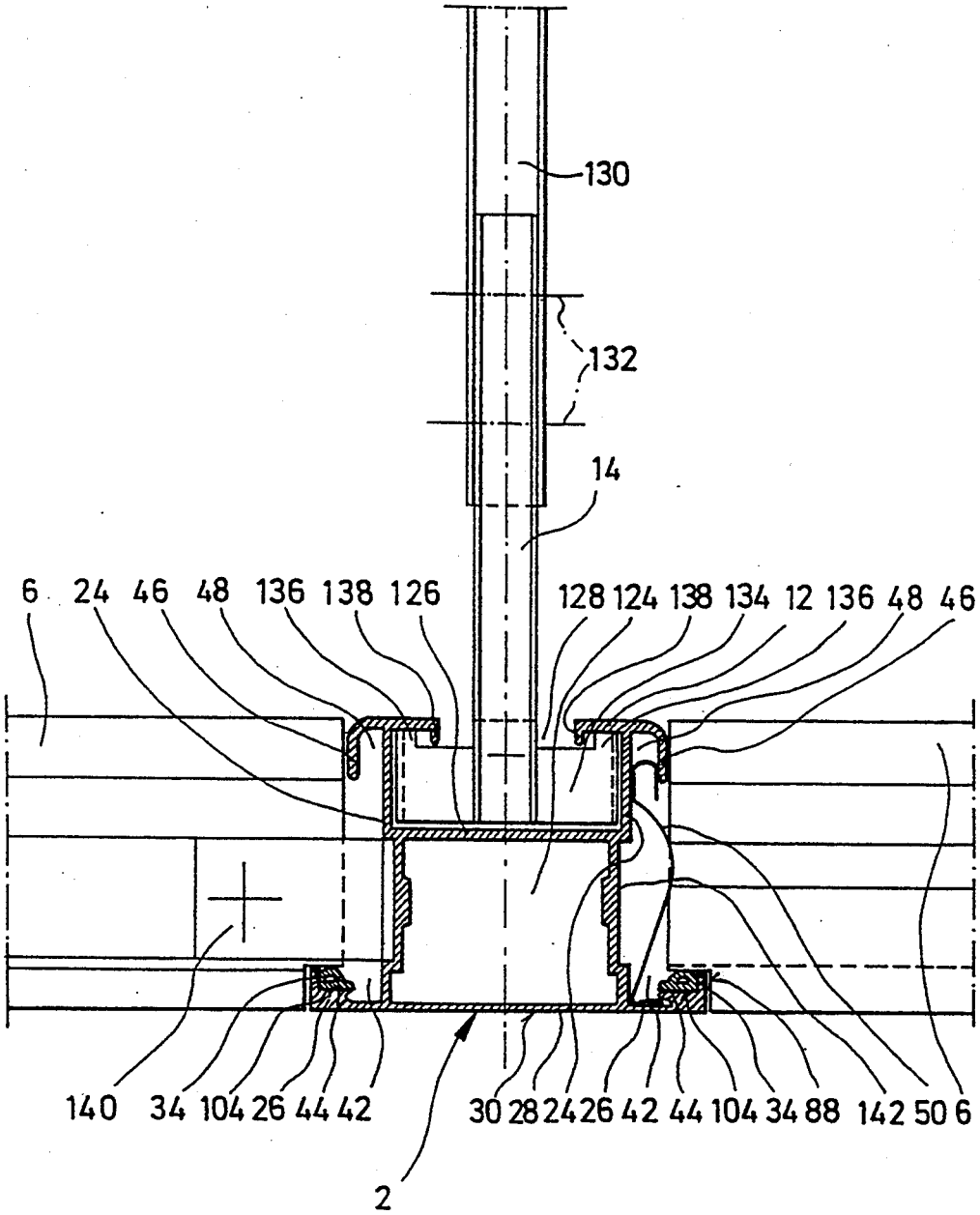
FIG. 6 is a sectional view of another embodiment of a longitudinal strut, similar to that of FIG. 3.

FIG. 6 is a sectional view, similar to that of FIG. 3, taken through a longitudinal strut of the supporting grid according to the invention, which corresponds substantially to the structure of the longitudinal strut shown in FIG. 3. Equal parts have been designated with the same reference numerals. The projections 26 of the longitudinal struts shown in FIG. 6 are provided with upward extending webs 34, upon which, as shown, the cassettes 6 come to lie with a horizontal surface of the step-like fold 88. It is thus ensured that the cassettes are always in close contact with the webs 34 so that the arrangement of the undersides 30 of the longitudinal struts and of the undersides of the cassettes 6 can be exactly matched and aligned. In the interspace defined between the long side 24 of the longitudinal strut and the web 34 there is disposed a seal 44 which has a plane lower contact surface 104 which can be joined with a horizontal area of the projection 26, for instance by means of an adhesive connection. The seal 34 is substantially tubular, and in the unloaded condition it has a height which is larger than the corresponding height of the web 34. In this way it is ensured that the seal 44 is always compressed to a given extent when the cassettes are placed thereupon.

The longitudinal strut shown in FIG. 6 is designed as a hollow profile and has a substantially rectangular, closed duct 124 which is defined by the underside 30, the long sides 24 and a horizontally extending separating web 126. The duct 124 is thus self-contained and sealed off against the superposed region of tubular cross-section 128. The region of tubular cross-section has a substantially U-shaped design, into which the suspension tongue 14 may be introduced as shown in FIG. 6.

The duct 124 can be used for leading electrical cables or pipes, for example for a sprinkler installation, therethrough. As it is sealed off by the separating web 126, it is also possible to attach ancillary devices on the underside 30 of the longitudinal strut 2, such as partitions, additional lights or the like, without impairing the tightness of the ceiling lining.

In the embodiment shown in FIG. 6, the suspension tongue 14 is connected to a suspended fixture 130, the attachment being effected by bolts or screws 132 which are indicated only schematically.

Similar to the embodiment shown in FIG. 3, the longitudinal strut has upper and lower grooves 48 and 42 respectively, which serve to hold a spring 50 or a spring member. FIG. 6 shows on its right hand side the embodiment of such a spring member 50.

In order to ensure a safe fastening to the suspension tongue 14, said tongue has a lower transverse region, at the upper outer edges of which there are arranged upward extending supporting tongues 136 which can be inserted into U-shaped grooves defined by the edges 138 of the top sides 12. In this way, disengagement of the suspension tongue 14 is safely excluded even when swingings or vibrations occur.

Attachment between the longitudinal strut 2 and a transverse strut 4 can be effected by means of an angle 140 which is provided in a longitudinal groove 142 of the long side 24 of the longitudinal strut 2. The angle 140 can be screwed for example with the longitudinal strut 2.

Figure 7:
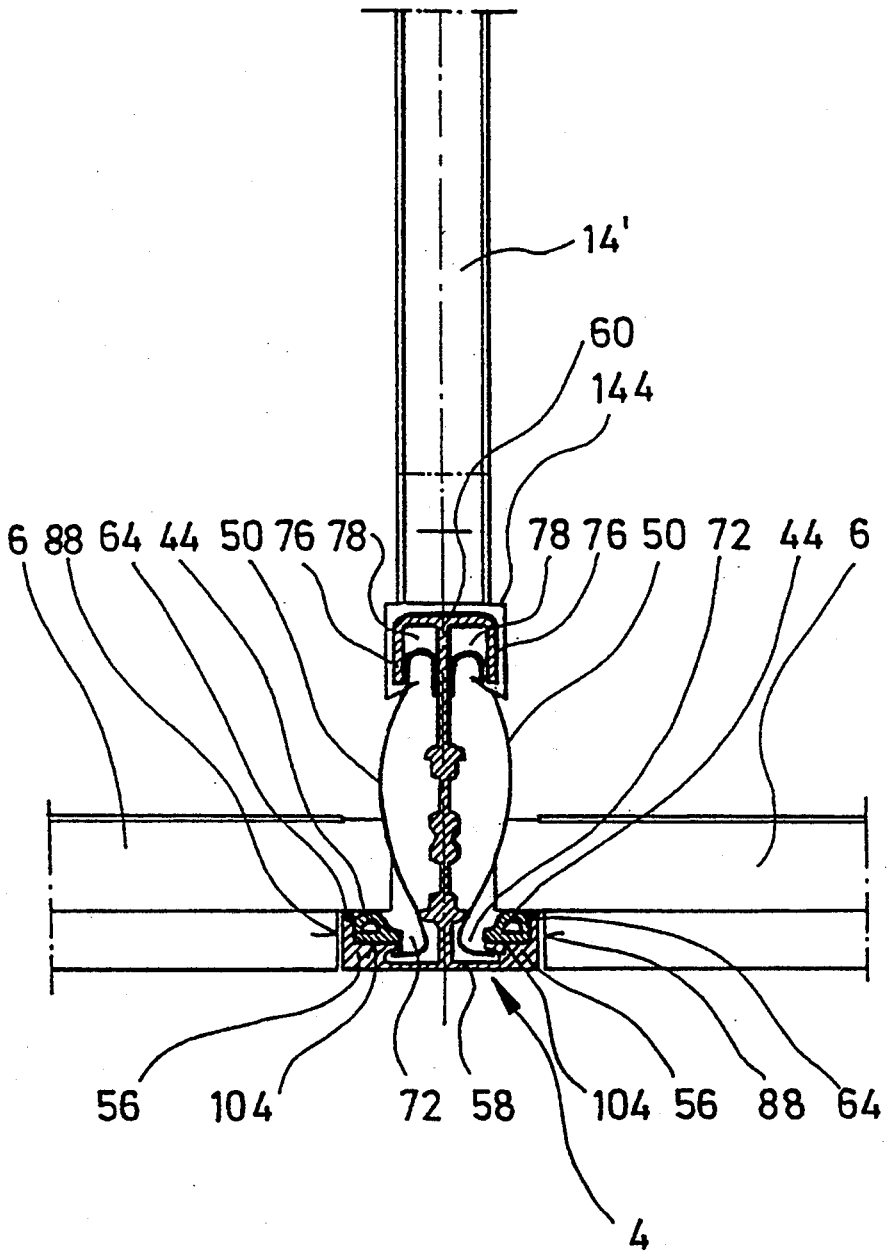
FIG. 7 is a sectional view of another embodiment of a transverse strut, similar to that of FIG. 2.

FIG. 7 shows the embodiment of a transverse strut, similar to FIG. 2, which in respect of its lateral structure is analogous to the longitudinal strut shown in FIG. 6. Also in this transverse strut the webs 64 are designed such that the step-like folds 88 of the cassettes come to lie upon the webs 64, but not on the seals 44. The seal 44 has the same design as in the embodiment shown in FIG. 6. Likewise the upper and lower grooves 78 and 72 respectively for receiving the spring members 50 are designed in the same way.

The transverse strut shown in FIG. 7 can be suspended by means of a suspension tongue 14' which has at its lower end a holding member 144 of substantially U-shaped cross-section, by which the upper portion of the transverse strut can be embraced. As shown in FIG. 7, the free ends of the holding member 144 are bent inward to engage the webs 76. Since not only the spring 50 but also the suspension tongues 14' extend only over a limited length of the transverse strut, there will not occur any undesired interaction between these two.

Figure 8:
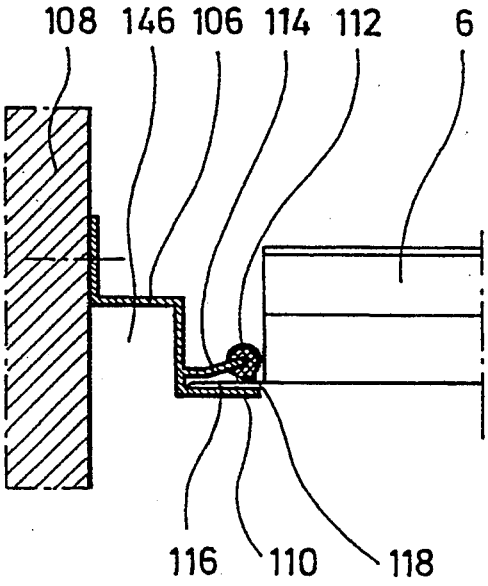
FIG. 8 is a sectional side view of a first embodiment of a wall end strut.
Figure 9:
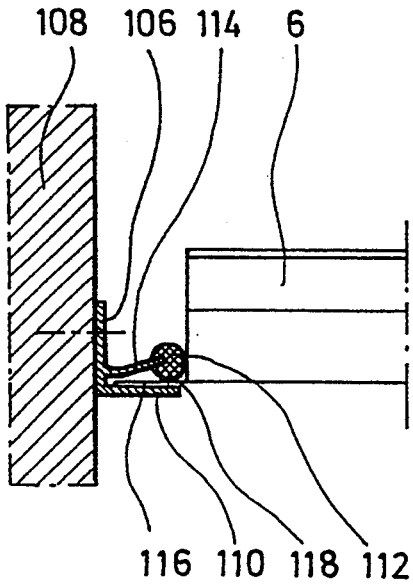
FIG. 9 is a view of another embodiment of a wall end strut, similar to that of FIG. 8.

FIGS. 8 and 9 show embodiments of a wall end strut according to the invention, by means of which the junction of a cassette 6 to the wall can be designed depending on the local conditions. The cassette 6 has a horizontal portion 116 which may be for instance a part of the underside of the cassette 6.

The wall end strut 106 has a first horizontal projection 110, upon which the horizontal portion 116 of the cassette 6 can be placed. Due to this design the cassette 6 is safely supported. Substantially parallel to the first projection 110 there is arranged a second projection 114 in one piece with the wall end strut 106. At the free end of said second projection 114 there is disposed a seal 112 which embraces the projection 114 and has at its underside at least one sealing lip 118 which is tensioned against the first projection 110. Thus, when the horizontal portion 116 is introduced, a reliable sealing is provided.

As shown in FIG. 9, the wall end strut 106 may have the form of an angle profile which can be screwed to a wall 108. However, as shown in FIG. 8, it is also possible to design the wall end strut 106 in form of a double-angle profile in order to form a shadow groove 146 in this way.

Figure 10:
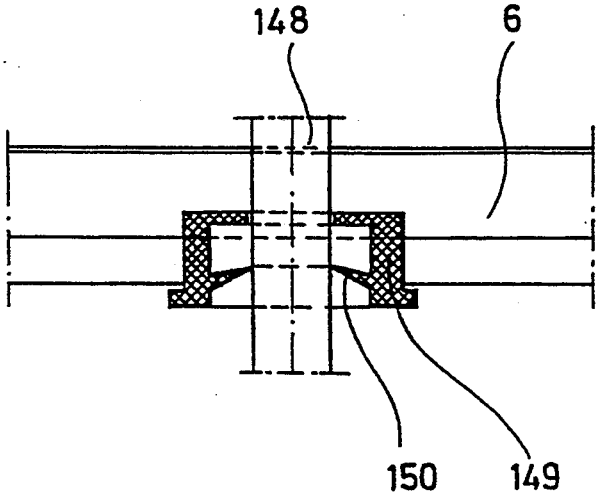
FIG. 10 is a sectional view taken through a cassette with an ancillary device in form of a pipe.

FIG. 10 shows an embodiment of a fitting (ancillary device) in a cassette 6. The fitting is designed as a pipe 148 which is shown only schematically and which can be used for example for a sprinkler installation. In an aperture through the cassette 6 there is placed an annular seal 149 which has an annular sealing lip 150 which sits close to the external surface of the pipe 148, thus providing a tight joint. The pipe 148 may be fastened either to the cassette 6 or to a ceiling arranged thereabove.

Figure 11:
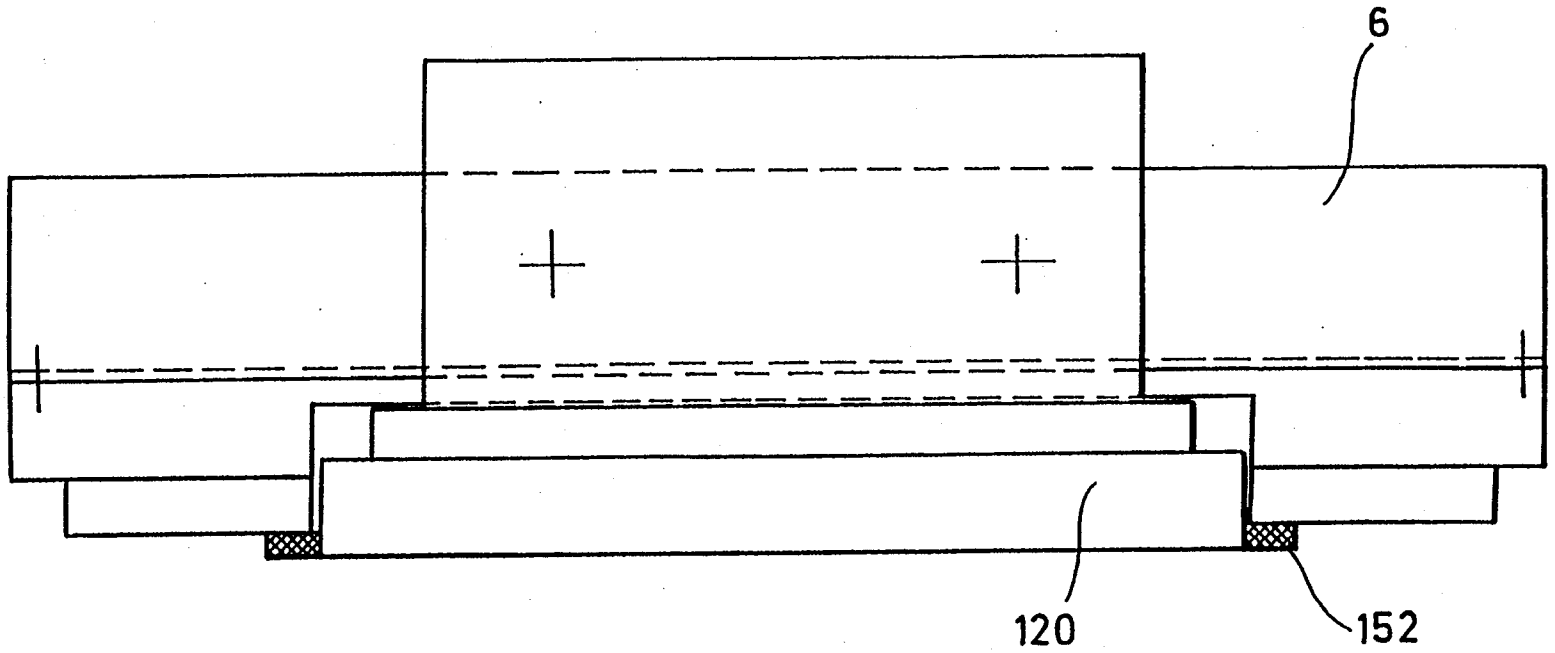
FIG. 11 is a sectional view taken through a cassette with an ancillary device in form of a lamp.

FIG. 11 shows another embodiment of a fitting (ancillary device) in a cassette 6, in form of a light 120 which is shown only schematically. The light 120 is fixedly connected with the cassette 6 and has a housing which is closed at the top side. The gas-tight sealing between the light 120 and the cassette 6 is achieved by a seal 152. The light 120 is mounted and dismounted together with the cassette 6.

Figure 12:
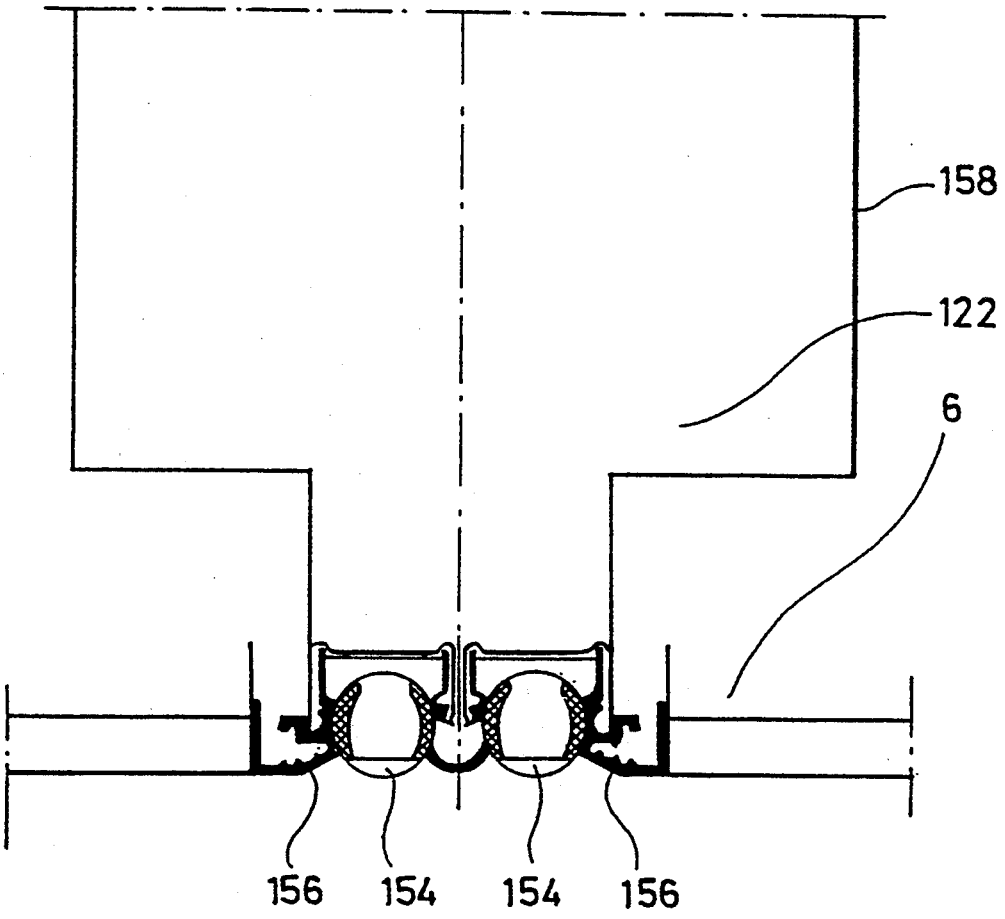
FIG. 12 is a sectional view taken through a cassette with an ancillary device in form of an air case.

FIG. 12 shows another embodiment of a fitting in a cassette, said fitting being an air supply or air discharge apparatus 122. A box 158 of the air installation 122 is sealed off against the top side of the cassette by means of seals 156 which are tightly attached to the cassette 6 and which may serve at the same time for supporting air nozzles 154. Also in such design it is possible to connect the air installation 122 with the cassette in a fixed manner.

Figure 13:
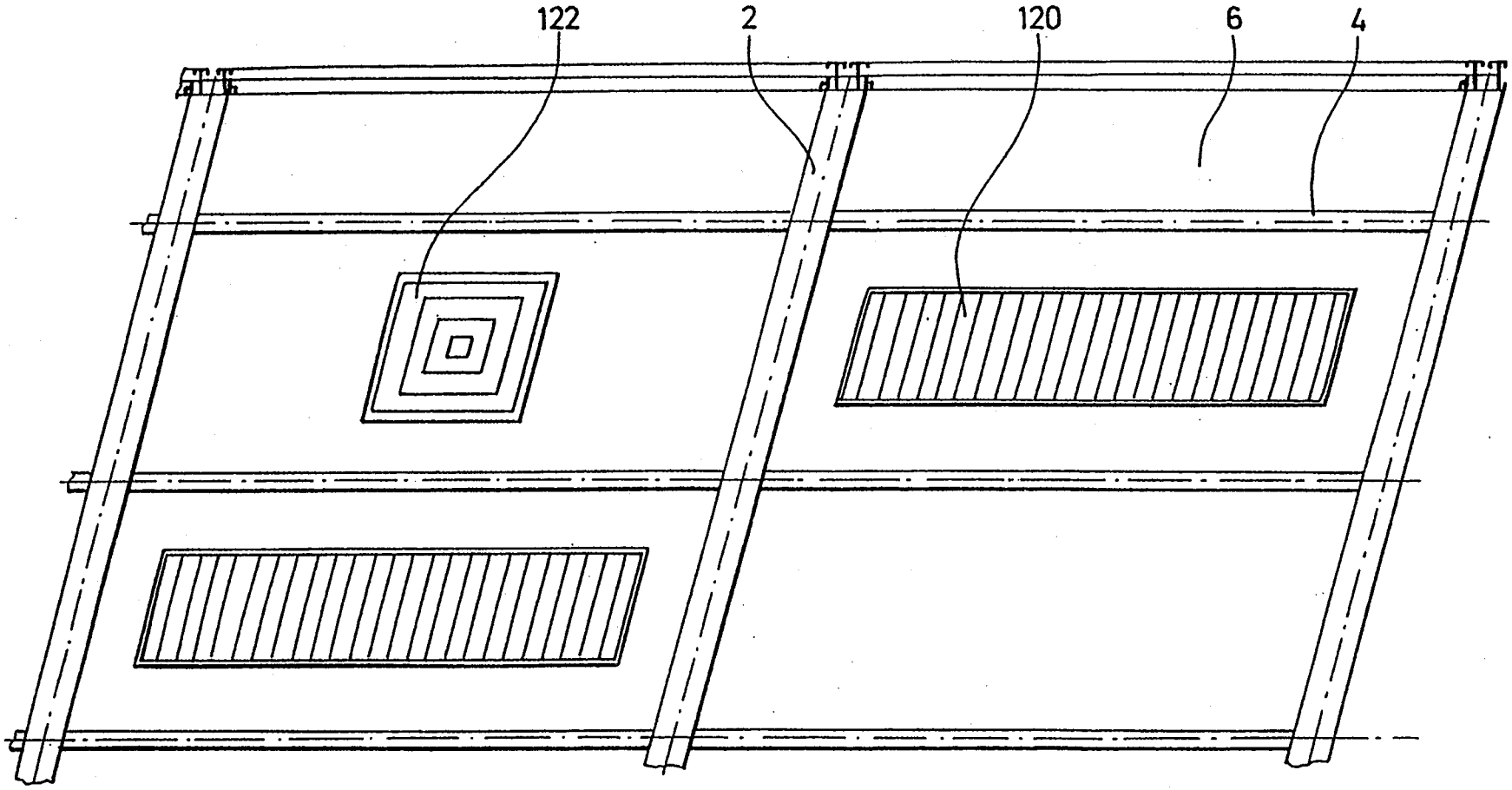
FIG. 13 is a perspective view from below of a ceiling lining according to the invention, with installations and cassettes in the assembled condition.

FIG. 13 is a perspective view from below of a ceiling lining according to the invention, in which between the longitudinal struts 2 and the transverse struts 4 there are mounted cassettes 6 which are partly equipped with light installations 120 or air installations 122.

The present invention is not restricted to the embodiments shown herein; rather there are numerous variations possible within the scope of the invention.

I claim:

1. Ceiling lining of metal, comprising a supporting grid and cassettes arranged in grid compartments of the supporting grid which is composed of longitudinal struts and of transverse struts connected to said longitudinal struts, each longitudinal strut and each transverse strut having substantially horizontal projections which are arranged on either side at the lower ends of said struts, extending in the longitudinal directions thereof, and provided on their top sides with tube-like seals upon which the cassettes sealingly lie, characterized in that on the top side of the projection there is arranged a web which extends upward and along said projection and upon which the cassette rests, the seal being disposed between the web and a side wall of the longitudinal strut and of the transverse strut, respectively, thereby defining a reliable flush, sealing arrangement between the longitudinal struts, the transverse strut, and the cassettes, the seal having, in an unloaded condition, a height which is greater than the height of the web.

2. Ceiling lining according to claim 1, characterized in that the seal has a plane contact surface which can be joined to the projection.

3. Ceiling lining according to claim 2, characterized in that the seal is manufactured of an elastic material with a closed surface.

4. Ceiling lining according to claim 3 characterized in that an additional web is arranged parallel to the web between the same and the side wall of the longitudinal strut and of the transverse strut, respectively, and that the seal is disposed between these two webs.

5. Ceiling lining according to claim 4 characterized in that the cassette has a circumferential step-like fold extending along its lower outer edge region and that it rests with a horizontal surface of said step-like fold upon the web in such a manner that the undersides of the cassette, of the longitudinal strut and of the transverse strut are arranged in one plane.

6. Ceiling lining according to claim 5 characterized in that lateral projections of the longitudinal struts and lateral projections of the transverse struts have the same design.

7. Ceiling lining according to claim 6, characterized in that spring members which secure the cassettes in their position are held on the longitudinal struts or on the transverse struts, respectively.

8. Ceiling lining of metal, comprising a support grid and cassettes arranged in grid compartments of the supporting grid which is composed of longitudinal struts and of transverse struts connected to the longitudinal struts, each longitudinal strut and each transverse strut having substantially horizontal projections which are arranged on either side at the lower ends of the struts, extending in the longitudinal directions thereof, and provided on their top sides with seals upon which the cassettes sealingly lie, the top side of the projection having a web which extends upward and along the projection and upon which rests the cassette, the seal being disposed between the web and a side wall of the longitudinal strut and of the transverse strut respectively, the sealing lining further including spring members which secure the cassettes in position, the spring members (50) comprising leaf springs, the ends of which are supported in grooves (42, 48', 72, 78) which are arranged and opposing each other in the side walls of the longitudinal or transverse struts.

9. Ceiling lining according to claim 8, characterized in that grooves (42, 48', 72, 78) are defined by the respective side wall and a parallel web (46, 76) extending downward from the upper end of the side wall to define an upper groove (48, 78), and by a web (38, 68) which is arranged on the top side (32, 62) of the projection (26, 56) and extends upward parallel to the side wall to define a lower groove (42, 72).

10. Ceiling lining according to claim 8, characterized in that the spring members (50) have between their two ends an angular portion whose one leg (94) extends in a substantially vertical direction, is resiliently supported against the lateral face of the cassette (6) and extends approximately as far as the upper edge (96) of the cassette (6), and whose other leg (98) extends above the upper edge (96) of the cassette and is angularly bent, sloping upward and inclined outward with respect to the side wall of the strut.

11. Ceiling lining according to claim 10, characterized in that one leg (94) is followed by a leg (102) extending to the lower groove (42, 72), and that the other leg (98) is followed by a leg (100) extending to the upper groove (48, 78).

12. Ceiling lining according to claim 11, characterized in that the legs (100, 102) of the spring member (50) which extend to the grooves are followed by spring end sections extending parallel to the side wall of the strut (2, 4).

13. Ceiling lining according to claim 12, characterized in that the grid compartments (10) adjacent to a wall (108) have a wall end strut (106) which is attached to wall (108) and supports cassette (6) in fixed relationship thereto.

14. Ceiling lining according to claim 13, characterized in that the wall end strut (106) has a horizontal projection (110), which extends in the longitudinal direction thereof and on whose upper side there is arranged a seal (112) for contact with the cassette (6).

15. Ceiling lining according to claim 14, characterized in that above the first projection (110) there is arranged a parallel second projection (114), under which a horizontal portion (116) of the cassette (6) can be introduced.

16. Ceiling lining according to claim 15, characterized in that the seal (112) has a U-shaped cross-section, is supported on the second projection (114), and has at least one sealing lip (118) pointing in the direction of the first projection (110).

17. Ceiling lining according to claim 16, characterized in that the cassette (6) is provided with apertures through which ancillary devices may pass, the apertures having sealing means to prevent unwanted air leakage through the apertures.

18. Ceiling lining according to claim 16, characterized in that the ancillary devices have the form of a lamp (120).

19. Ceiling lining according to claim 17, characterized in that the ancillary devices have the form of an air supply/discharge installation (122).

* * * * *

UNITED STATES PATENT AND TRADEMARK OFFICE

CERTIFICATE OF CORRECTION

PATENT NO. : 5,410,853

DATED : May 2, 1995

INVENTOR(S) : Hartleif

It is certified that error appears in the above-indentified patent and that said Letters Patent is hereby corrected as shown below:

Column 9, line 50, delete "support" and insert --supporting--.

Signed and Sealed this

Eleventh Day of July, 1995

Bruce Lehman

*Attest:*

BRUCE LEHMAN

*Attesting Officer*

*Commissioner of Patents and Trademarks*